United States Patent [19]

Sciortino

[11] 4,394,861

[45] Jul. 26, 1983

[54] OUTSIDE AIR BREATHING SUPPLY SYSTEM

[76] Inventor: Lawrence A. Sciortino, 313 Yacht Club Dr., Fort Walton Beach, Fla. 32548

[21] Appl. No.: 262,232

[22] Filed: May 11, 1981

[51] Int. Cl.[3] ..... A62B 7/00

[52] U.S. Cl. ..... 128/205.25; 128/205.24; 244/118.5

[58] Field of Search ..... 128/200.24, 201.22–201.29, 128/202.11, 202.13, 202.19, 204.18, 205.25, 206.12, 206.27, 206.28, 207.12, 202.27, 205.24, 205.26, 205.28, 206.15, 206.21, 204.15, 204.17, 200.28, 201.15; 98/1.5, 2, 33 R, 2.12, 2.13, 2.16, 44, 35, 64, 13, 18; 251/353; 244/118.5

[56] References Cited

U.S. PATENT DOCUMENTS

| | | | |
|---|---|---|---|
| 1,379,162 | 5/1921 | Brown | 98/64 |
| 2,058,659 | 10/1936 | Bellanca | 244/118.5 |
| 2,389,313 | 11/1945 | Hunter | 98/18 |
| 2,460,604 | 2/1949 | Simcox | 98/13 |
| 2,810,386 | 10/1957 | Reed | 128/201.15 |
| 2,954,027 | 9/1960 | Marasco | 128/206.28 |
| 3,295,522 | 1/1967 | Johnson | 128/201.23 |

FOREIGN PATENT DOCUMENTS

| | | | |
|---|---|---|---|
| 741127 | 12/1932 | France | 128/202.11 |

*Primary Examiner*—Henry J. Recla
*Attorney, Agent, or Firm*—James Creighton Wray

[57] ABSTRACT

Outside air is provided to pilots or passengers when cockpit air is contaminated. A ram air source is provided on the aircraft, and flexible hose is connected to the ram air source. Outlet means on an end of the hose remote from the ram air source directs a flow of air from the ram air source and through the flexible hose to facial areas of one or more users for breathing outside air flowing through the system from the ram air source.

13 Claims, 15 Drawing Figures

FIG. 1
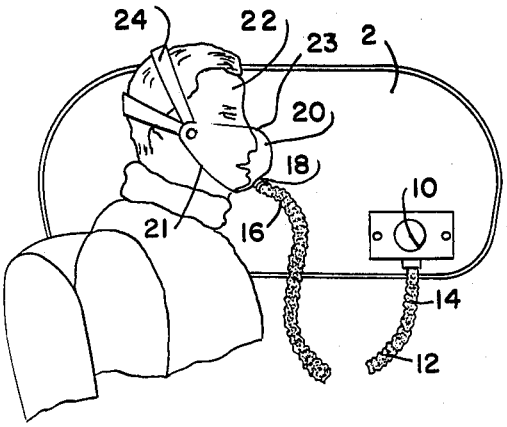
FIG. 3
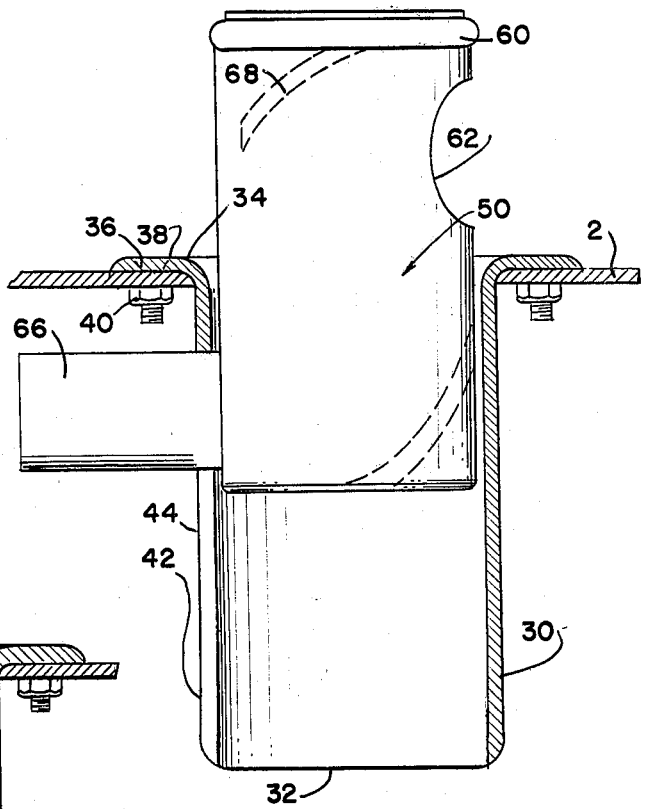
FIG. 2
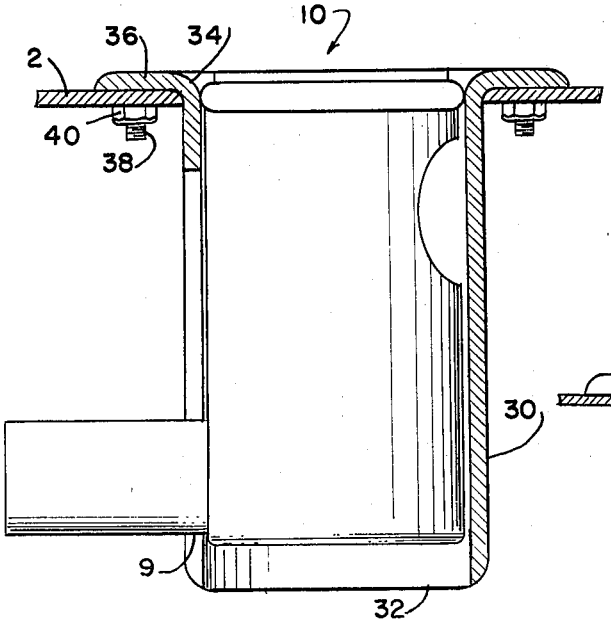
FIG. 4
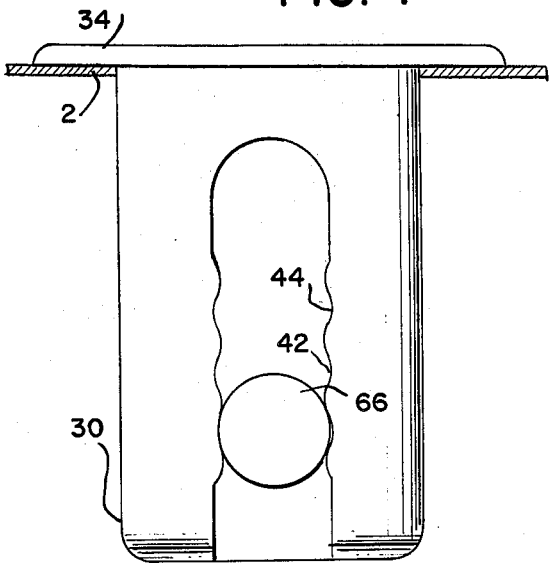
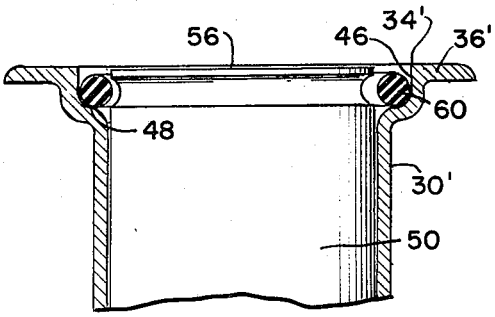
FIG. 2A

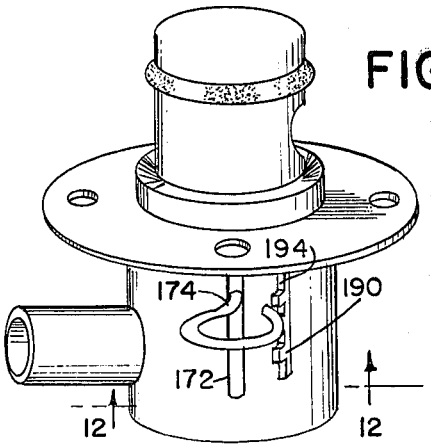
FIG. 11
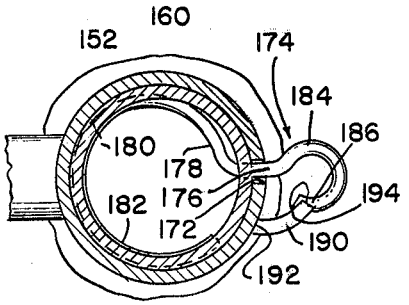
FIG. 12
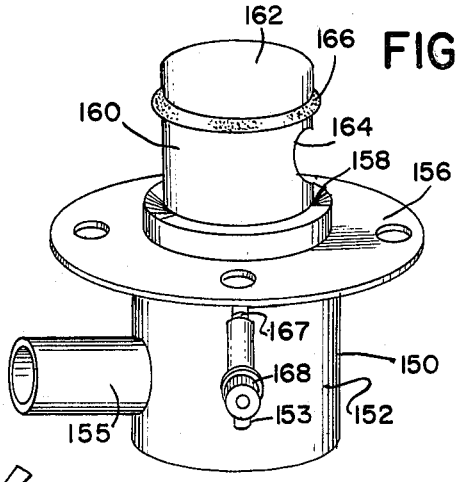
FIG. 10
FIG. 14
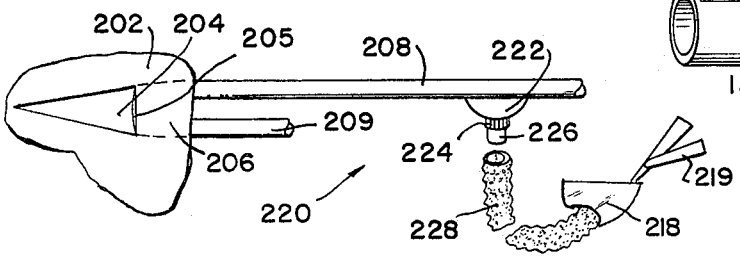
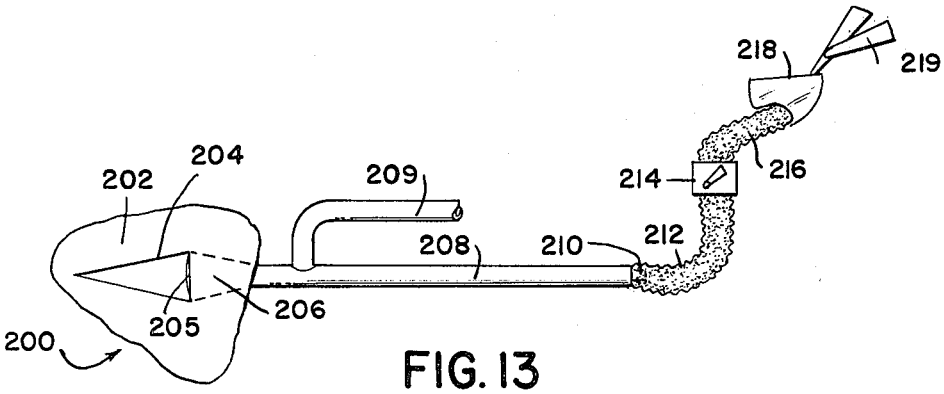
FIG. 13

OUTSIDE AIR BREATHING SUPPLY SYSTEM

BACKGROUND OF THE INVENTION

Most small aircraft have no emergency breathing apparatus. Because the small aircraft operate within ceilings in which air may be comfortably breathed, there are no special requirements for auxiliary breathing apparatus on such aircraft.

A potentially lethal situation may develop from an otherwise minor malfunction or minor emergency in an aircraft. A smoldering fire caused by a dropped cigarette or an electrical fire may produce noxious smoke. Carbon monoxide or fuel fumes or other nauseating or noxious fumes may fill an interior of an aircraft or at least a cockpit area.

The results are potentially lethal because, while an occupant of an automobile may simply pull the vehicle to the side of the road and alight, such an option does not exist for the pilot or his passengers. The plane must be flown to a safe landing area and landed. The highest of skills may be required in landing such a disabled aircraft at a time when the contaminating gaseous substances produce increased disability to the pilot. For example, exposure to carbon monoxide may slow reactions and cause drowsiness. Smoke may cause eye irritation and increasingly interfere with vision at the same time as breathing difficulties and coughing and choking increase. The result may be that a problem of initial minor nature may rapidly and geometrically increase to a major life-threatening problem because of the time required to escape from the surroundings and the inavailability of fresh air for breathing and washing fumes and gasses away from eyes.

Prior Art

Before preparing an application, a search was made in Class 244, Aircraft, for aircraft emergency outside air breathing supplies. A search was also made for respirators in Class 128, ventilators in Class 98, and fluid handling in Class 137. No pertinent patents were found.

Emergency oxygen supply apparatus for aircraft is described in U.S. Pat. No. 3,379,195. A mask with goggles for flushing air out of eye areas is described in U.S. Pat. No. 4,126,131. An oxygen mask and hose system is described in U.S. Pat. No. 2,999,497. A relatively inexpensive face tent of the type suitable for use with the present invention is described in U.S. Pat. No. 4,207,888.

U.S. Pat. No. 3,657,740 describes a ventilation system which delivers a stream of air to a welder's face mask. A pull-out general ventilation system with fixed air scoop is described in U.S. Pat. No. 1,836,438. None of those devices show or suggest the system, method or apparatus of the present invention.

SUMMARY OF THE INVENTION

The present invention provides an air emergency outside breathing system and method primarily intended for use with aircraft. A ram air source which may be a fixed ram air source built into the aircraft has one or more flexible hoses connected to the ram air source and outlets connected to the flexible hoses remote from the ram air source for directing flow of outside air to facial areas of one or more users for breathing outside air flowing through the system from the ram air source. The emergency breathing system is intended primarily for use during periods of contamination of interior air. However, the breathing system may be used at any time when it is desired to breath outside air, for example, during periods of temporary air sickness or discomfort.

The system broadly encompasses built-in systems and add-on systems.

In the built-in systems, conventional ram air sources such as Nasa air scoops may be employed. The air scoop may lead to a plenum for providing pressurized air, or the air scoop may lead to internal fixed piping for ducting air near to seat positions of users. Near the seat positions, flexible hoses may be connected to the rigid pipes, with masks or face tents mounted on distal ends of the hoses or with mouth pieces mounted on distal ends of the hoses for fixing the distal ends to a head of a user so that the outside air may be breathed. In one form of the invention proximal ends of hoses may be connected to "eyeball" type valves mounted at termini of fixed ram air distribution systems.

In an add-on system, a flange on an open end of the pipe-like mount fits around an opening in an aircraft body or window. A valve body moves within the mount and has a closed end which normally seals the opened outer end of the mount. In times of emergency the valve body is extended into the airstream, exposing a ram air opening. The ram air feeds through the valve body and out a hose connection at an inner end of the apparatus. A flexible hose is connected to a face mask which floods the mouth, nose and eyes with fresh outside air.

The present invention provides a system and method and apparatus for quickly deploying an air scoop into an air stream surrounding an aircraft to scoop in fresh air from an air stream and to deliver the air under ram air pressure to the facial area of the user to provide fresh breathing air and air for flooding an area of the eyes.

The apparatus includes a fitting for connecting to an external surface skin or window of an aircraft, an air scoop valve for extending into an airstream flow and for scooping air inward, a connection to the fitting or valve for receiving a flexible hose and a means at the distal end of a flexible hose for washing the air over the face of a user.

In a preferred embodiment, the fitting is tubular and has an open outer end surrounded by a flange. A combined valve and scoop move within the mounting means partially outward into the airstream to expose a scoop opening. A hose connection is connected to the tubular body or to the valve-air scoop. A proximal end of the hose is mounted on that connection and the distal end of the hose is joined to the mask which fits below the mouth, nose and eyes of the wearer and flushes air upward.

In one embodiment of the invention, the tubular mounting means has a closed inner end, and the valve opens into the mounting means, and the hose connection is mounted on the mounting means. In another embodiment the hose connection is mounted on the valve body. In the latter embodiment, the hose connection may be mounted on or near a closed inner end of the valve body. When the hose connection is mounted laterally on the valve body, a slot is provided in the tubular mounting means to allow the hose connection to move longitudinally along the mounting means.

The outer end of the mounting means is sealed by the valve body. In one embodiment an O-ring surrounds the valve body near the outer end and fits against the inside of the mounting means for complete sealing. A ram air scoop opening may be formed in the side wall of a tubular valve body, and the ram opening may be fully exposed to the air stream or may be partially exposed. Baffles opposite the ram air opening and hose connection reduce turbulence and increase air flow.

The valving and scooping function may be provided by a cover hinged to the flange of the mounting means when the cover is inclined into the air flow, lateral extensions are also exposed to aid the scooping function.

In one embodiment with an open inner end in the mounting means, the valve body may be pushed outward into operational position simply by center pressure on the inner closed valve body end, such as with a thumb. Valve body and mounting interior may be closely fit, roughened, grooved or serrated to hold the desired position. In one form, the hose connection extends radially from an inner end of the valve body, and a U-shaped longitudinally extending slot is roughened or notched to grip the hose connection in the desired positions.

In embodiments of the invention in which the inner end of the mount is closed, the valve may be operated by a pin connected to the valve and extended through the mount, with a nut-like cap on the threaded pin torqued to hold the two elements in desired relative position. A lever or a combination of levers may be used to move the valve with respect to the mounting means.

In one embodiment, the mounting means may be made of a short length of one inch plastic pipe, PVC schedule 40. A sliding valve may be made from a slightly smaller pipe with a 3/16 inch thick $\frac{5}{8}$ inch radially extending flange at one end of the mounting pipe. An outlet nipple approximately $\frac{7}{8}$ inch in outer diameter is connected to the mounting means or sliding valve to receive a proximal end of a flexible hose which may be what is known as a big bore hose, a flexible plastic disposable medical oxygen hose. A convenient face mask may be of the face tent type described in U.S. Pat. No. 4,207,888. Alternatively, the distal end of the hose may be mounted in a convenient place near to the face of the user, or may be flattened and configured for attaching near the face of the user or may have a mouthpiece device so that the user may grip the hose or its attached mask in his teeth, temporarily while straps are being affixed or for the full time of the descent to a safe landing.

The purpose of this invention is the provision of a means for having fresh, outside ram air ducted to the mouth and/or nose of the occupant of an enclosed space such as in an aircraft for breathing such outside air exclusively or for any desired use, such air being available immediately upon the demand and under the control of the occupant. The outside air is caused to flow through the ram effect of the outside air when such vehicle is in motion relative to the outside air or the outside air is in motion relative to the enclosure occupied.

The ram air flow provides means for occupant breathing outside air while in vehicle. Outside fresh air is directed to a nose and/or mouth of vehicle occupant through a flexible duct or hose so that occupant can move about within the vehicle while breathing fresh flowing outside air. The occupant may breathe air from outside of vehicle exclusively when desired, thereby achieving independence from air within the vehicle.

A pipe with a flange at one end and an axial slot at the other extends into an aircraft body or window, with a flange mounted exteriorly. A pipe with closed ends fits within the mounting pipe, a radial outlet nipple extends from the inner pipe through the slot. A radial opening near the other end of the inner pipe acts as an inlet when the inner pipe is pushed outward. The amount of opening and amount of flow can be controlled by controlling the position of the inner pipe within the outer pipe.

A ram air inlet valve included in this invention is made up of two basic parts, an inner hollow cylinder and an outer hollow cylinder both approximately the same in length. These cylinders may be made of plastic or metal or other suitable material. The wall thickness of above cylinders is such that dependent on the property of the material used for their fabrication, they are structurally strong enough to perform their intended use. In one embodiment the outer cylinder has a circular mounting flange at its outer end and is open at both ends. The outer cylinder has a channel which begins at its inner end and stops short of the outer flange end. This channel serves as a guiding track and movement limiter for the inside cylinder. The outer end of the inside of the cylinder is somewhat larger in diameter than the rest of the inside of the cylinder, so made that it will accept a ring seal which is part of the inner cylinder. The outer cylinder mounts through a hole in a vehicle's outer skin or window or windshield. Such hole is cut round and slightly larger in diameter than the outside diameter of the outer cylinder, but smaller than the outside diameter of the outer cylinder's integral mounting flange. The outer cylinder is mounted through said hole by insertion from the outside of the vehicle. The flange is then fastened permanently with screws or bolts which go through the flange and through holes drilled in the window or windshield material. The inner cylinder is sized so that it fits within the outer cylinder closely but can be moved freely in a sliding motion. Both ends are closed. Near the inner end of the cylinder is an outlet nipple which extends out of the side wall of the inner cylinder. This nipple is itself hollow and open at both of its ends thereby providing an outlet to the ducted space within the inner cylinder. The outside diameter of the nipple is such that it fits snuggly through the channel in the outer cylinder and provides guidance and limit to the travel of the inner cylinder.

Near the outer end of the inner cylinder is an inlet port in its side wall oriented so that it faces into the relative air movement. Between the outer edge of the above mentioned port in the outer end of the inside cylinder is a rubber seal which locates in a circumferential groove around the cylinder. The rubber seal is a ring which is stretched into its groove where it nests deeply enough to hold it securely in place but is not entirely submerged into the cylinder's wall. The outer circumference of the rubber seal ring is therefore greater than that of the inner cylinder. The inner cylinder is installed by inserting it into the mounted outer cylinder from inside the vehicle. Without the rubber ring installed, it is inserted port end first so that the nipple of the inner cylinder lastly tracks into the channel of the outer cylinder to the limit of its travel. The rubber ring seal is then installed from the outside and the cylinder is pulled inward to its retracted position. The ring seal slides into the seat formed in the outer cylinder and makes a flush and weather-proof closure. When the inner cylinder is extended, any part or all of its inlet port is exposed outside of the mounting flange. Ram air enters the port, passes through the inner cylinder and out of the outlet nipple. A duct, rigid or flexible, is connected to the nipple. At the other end of the duct a face mask or tent or mouthpiece is attached and is used for breathing when the ram air port of the inner cylinder is deployed.

Other constructions have been contemplated.

The air duct may be rigid or flexible, flexible being preferred. The flexible duct or hose can be made from several materials: woven fabric, rubber, flexible synthetics of many types, reinforced paper, etc. The end of the flexible duct itself can be used as a breathing terminal by insertion in user's mouth or by any means of positioning so that the air flow is directed to the user's nose and/or mouth or may be directed toward any desired use by the occupant. Any sort of mask or face tent may be employed at the breathing end of the flexible duct for facilitating breathing. Any type of mouth piece, including self retaining types such as those used in underwater breathing devices, may be used. The design of the part which admits and/or controls the ram outside air is part of this invention but it is not a necessary part, as other designs for the admission and control of ram air are contemplated by this invention. Existing fresh air vents within the vehicle can be connected directly to the flexible duct as may be possible when vent size permits direct mating with the flexible duct, or an adapter may be used to permit the mating of an existing fresh air vent and the present duct.

Emergency outside air breathing supply apparatus has an outward opening valve mounting means for mounting on an outer surface of an aircraft body, valve means connected to the mounting means for opening and closing the outward opening of the mounting means, the valve means having means for extending outside of the aircraft body when the valve is open for extending into an airstream flowing by the outward opening and scooping air inward and distribution means for conducting air scooped from the airstream to a facial area of the user, the distribution means including a flexible hose having a proximal end connected to one of the mounting means and the valve means and having a distal end, and having a flow directing means connected to the distal end for directing flow from the distal end of the hose toward a face of a user.

In a preferred embodiment the mounting means has an annular body having a first axial end with an opening and having a flange radially extending from the first axial end for mounting on a surface of the aircraft with the body of the mounting means extending through an opening of the surface inward in the aircraft, the flange operating to seal the opening in the aircraft surface.

In one embodiment, the mounting means has an open outer end, and a valve body has a configuration similar to a body of the mounting means and fits within the mounting means. The valve body has a closed outer end and a ram air opening in a wall of the valve body near the closed outer end. Means for pushing the valve body partly outward through the opening in the outer end of the mounting means exposes the opening in the wall of the valve body to air flowing by the mounting means, and air is rammed into the opening.

In one embodiment, the valve body has a connection means remote from its closed outer end for connecting the proximal end of the flexible hose to the valve body. An opening in the mounting means receives the connection means. The valve body may be moved in the mounting means to positions in which the opening in the wall of the valve body is positioned fully within the mounting means out of air flow and a position in which the opening in the side wall is positioned outward of the outer opening in the mounting means and intermediate positions in which the opening in the side wall of the valve body is partially exposed to air flowing outside the aircraft.

In one embodiment, the connection means is mounted in a side wall of the valve body in a position remote from the ram air opening in the side wall. The opening in the mounting means for receiving the connection means comprises a U-shaped opening extending from a second end of the mounting means toward a first end of the mounting means. In another embodiment, the U-shaped opening is irregular, whereby the connection means is gripped by the opening for holding varied positions of the valve body with respect to the mounting means.

In a preferred embodiment, a second end of the mounting means is closed and a second end of the valve body is open. A connection means is connected to the mounting means for connecting the proximal end of the flexible hose to the mounting means.

A groove extends around the valve body between the first end and the opening in the side walls. An O-ring partially positioned in the groove extends outward for contacting an inner wall of the mounting means in a sealing relationship.

Positioning means connected to the valve body and to the mounting means moves the valve body with respect to the mounting means to control exposure of the ram air opening in the side wall of the valve body to air flowing outside the aircraft.

In one embodiment the valve means comprises cover means for overlying an opening in an outer end of the mounting means. Positioning means is connected to the cover and to the mounting means for closing or opening the cover and for holding the cover closed or open in preselected positions to scoop air flowing outside the aircraft into the mounting means. The mounting means has a closed second end and has a connection for mounting the proximal end of the flexible hose.

In a preferred embodiment the flow directing means comprises an upward opening mask having means for holding the mask on a chin of a user and for directing air upward over the mouth, nose and eyes of the user.

This invention provides an outside air breathing supply system having an air scoop for scooping air from an air stream. One embodiment has means for deploying the air scoop in the air stream, and means for withdrawing the air scoop from the air stream. A further embodiment has a hose connection connected to the air scoop. A further embodiment has a hose with a proximal end connected to the hose connection. A further embodiment has air directing means connected to a distal end of the hose. A further embodiment has attaching means for attaching the directing means to a head of a user.

One form of the air scoop for scooping an air from an air stream surrounding an aircraft comprises a tubular body having a closed outer end and having an air scoop opening in a side of the tubular body facing an air stream, and a second tubular body in which the first tubular body slides. Preferably the second tubular body has a closed inner end and a hose connection. The means for deploying the air scoop and means for withdrawing the air scoop comprise adjustable connection means between the first and second tubular bodies.

An outside air breathing system of a preferred embodiment has a ram air source, flexible hose means connected to the ram air source and outlet means connected to the flexible hose means remote from the ram air source for directing flow of air from the ram air source and through the flexible hose means to facial areas of one or more users for breathing outside air flowing through the system from the ram air source. Preferably a valve in the system is connected to one of the ram air source, the flexible hose means and the outlet means for stopping, permitting or controlling flow of outside air through the system.

In the preferred method for breathing outside air, air and an enclosure relatively move, air is flowed into the enclosure by virtue of the relative movement between the air and the enclosure. Air flowed into the enclosure is ducted and air flowed into the enclosure and through the ducting is released at facial areas of one or more users for breathing outside air.

BRIEF DESCRIPTION OF THE DRAWINGS

FIG. 1 shows a pilot using the emergency breathing apparatus of the present invention.

FIG. 2 shows a valve of the present invention and FIG. 2A shows a detail of a preferred modification of the apparatus shown in FIG. 2.

FIG. 3 is similar to FIG. 2 with the exception that the valve is open.

FIG. 4 is a side elevation of the valve shown in FIGS. 2 and 3.

FIG. 10 shows an embodiment of the invention having a ball nut on the end of a threaded pin radially extending from the inner body through a slot on the outer body.

FIG. 11 shows a preferred embodiment of a spring pin controlling relative body positions. FIG. 12 is a detail of the spring pin.

FIGS. 13 and 14 show the system of the present invention used with built-in ram air supply systems.

DETAILED DESCRIPTION OF THE DRAWINGS

Figure 5:
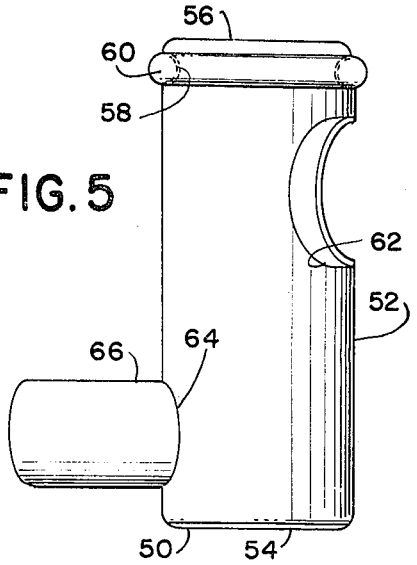
FIG. 5 is a detail of the valve body removed from the apparatus shown in FIGS. 2, 3 and 4.

Referring to the drawings, an aircraft window is generally indicated by the numeral 2. A mounting means and valve generally indicated by the numeral 10 are mounted on the aircraft window 2. A flexible hose 12 has a proximal end 14 connected to the window mounted device and a distal end 16 connected to a nipple 18 on a face tent 20. Face tent 20 is mounted on the pilots head 22 using straps 24. As shown in the drawings, the face tent has a lower edge 21 which is closely fitted to the neck and chin of the wearer. Upper edge 23 is open to allow air to flow upward and over the eye area of the wearers head 22. The mounting and valve device is shown in more detail in FIGS. 2–5. Mounting means 30 has a open inner end 32 and an open outer end 34 surrounded by a flange 36. Bolts 38 embedded in flange 36 are secured to aircraft window 2 with nuts 40. Mounting means 30 has a slot 42 with indentations 44 for receiving the nipple 66 mounted on the valve body 50.

In the preferred form as shown in FIG. 2A, the mounting means 30' has a chamber 46 near the open upper end 34' to receive O-ring 60 mounted on the valve body. Base 48 of the chamber locates the O-ring with the closed outer end 56 of valve body 50 flush with the outer surface of flange 36'.

As shown in FIG. 5, valve body 50 is a hollow body closed at inner end 54 and outer end 56. The outer wall 52 of the valve body is substantially cylindrical. A groove 58 in the upper end of the wall receives O-ring 60 which seals the valve body and the mounting means when the valve is in the closed position. A ram air opening 62 is formed in the cylindrical wall 52 near the upper end 56 and O-ring. A nipple connection means 66 is bonded to an opening 64 formed remote from opening 62.

As shown in FIG. 3 when valve body is in the open position, ram air opening 62 is exposed to an air stream flowing outside the aircraft surface 2 and the ram air is conducted out through nipple 66 to hose 11 as shown in FIG. 1. Baffles 68 bonded inside of body 50 aid in flow of the ram air out through nipple 66.

Figure 6:
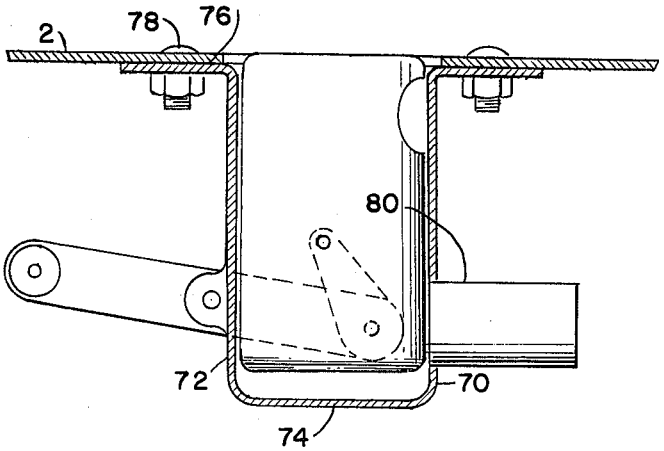
FIG. 6 is an alternate form of the invention.
Figure 7:
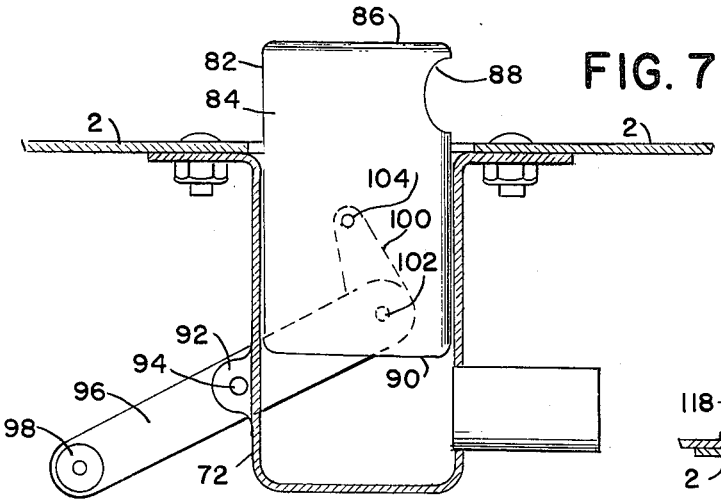
FIG. 7 is a view of the apparatus shown in FIG. 6 being in the open position.

A modification of the invention is shown in FIG. 6. Mounting means 70 has a generally cylindrical body 72 with a closed inner end 74. Flange 76 surrounds the open upper end of the mounting means 70, and bolts 78 secure the flange to aircraft surface 2. Nipple 80 is connected to an opening in cylindrical wall 72. As shown in FIG. 7 a clevis 92 and pin 94 are secured to wall 72 of the mounting means. Lever 96 with handle 98 is hinged to the clevis and extends inward through a slot in wall 72. Link 100 is connected to arm 96 with pin 102, and pin 104 is connected to the valve body 84. When handle 98 is pulled inward the valve body 84 with the cylindrical wall 82 is pushed outward exposing ram air opening 88. The outer end of the valve body 86 is closed and the inner end 90 is open.

Figure 8:
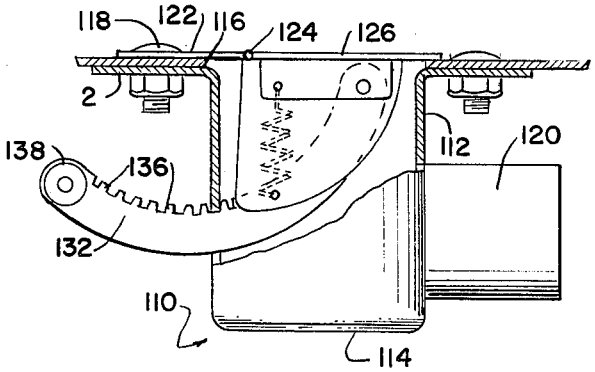
FIG. 8 is a closed positional view of an alternate form of the invention and FIG. 9 shows the device of FIG. 8 in its open position.
Figure 9:
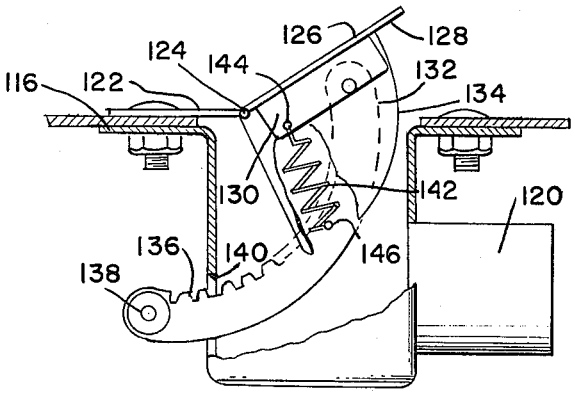

In the embodiment of the invention shown in FIGS. 8 and 9 the air scoop portion of the apparatus is generally indicated by the numeral 110. The mounting means has a generally cylindrical or rectangular wall 112 with a closed inner end 114. Flange 116 surrounds the open outer end. The flange is bolted to aircraft skin or window 2 with bolts 118. Hose connection 120 is connected to wall 112. When the device is closed the cover tightly seals the opening in the outer end of the mounting means.

In the open position as shown in FIG. 9 cover 126 is hinged from a pin 124 on a plate 122 which is integral with, bonded to or welded to mounting flange 116. Alternatively the plate 122 may be fixed to the mounting flange via the bolts 118. Lip 128 of cover 126 overlys the remainder of flange 116 in sealing relationship. The body 130 of the cover extends downward into the cavity formed in the mounting means. Sides 134 are formed on the body to assist in the scooping of air into the mounting means. Lever 132 has a distal end connected to a pin which is connected to body 130. The proximal end of lever 132 has a handle 138. Teeth 136 cooperate with the edge of a slot 140 formed in a mounting means to hold the cover in fixed position. Spring 142 is connected between pin 144 on cover 130 and pin 146 on lever 132 to pull the lever outward, or upward as shown in FIG. 9 so that teeth 136 engage the outer edge of slot 140.

In an alternate form of the invention a sliding inner pipe such as shown in FIGS. 6 and 7 has a pin radially extending through a complementary slot in the mounting means such as 70. The outer end of the radial extending pin is threaded, and a bead is threaded on the pin. The bead is slightly loosened by turning counterclockwise and the fingers grip the bead to push the valve body 84 outward or inward. Tightening the bead on the thread fixes body 84 in the desired position.

As shown in FIG. 10, a valve body 160 is held in open position within a mounting means 150. The mounting means 150 has a generally cylindrical wall 152 with closed inner end 154. A hose connection 155 is secured about an opening in cylindrical wall 152. A slot 153 is provided in cylindrical wall 152 as further will be described.

Flange 156 surrounds an upward extension 158 of the cylindrical wall of the body. Extension 158 extends through the skin or a window of an aircraft or other vehicle. An outer end of the mounting means is open and terminates in an inward taper which receives an O-ring on valve body 160, as is later described. Valve body 160 has a cylindrical shape which is slightly smaller than the corresponding internal dimension of mounting means 150. An outer end 162 of valve body 160 is closed, and a ram air opening 164 is formed in a leading area of the cylindrical surface of valve body 160 near the outer end. O-ring 166 fits in a groove in the cylindrical wall of valve body 160 near its outer end 162. When the valve body is pulled inward, the O-ring mates with the tapered surface at the outer end of mounting means 150.

A radially extending pin 167 is permanently connected to valve body 160 near its inner terminus. The outer extremity of pin 167 is threaded to receive a beaded nut 168. Nut 168 which stands outward away from cylindrical wall 152 of mounting means 150 is slightly loosened on threaded pin 167 to permit sliding of the valve body 160 by moving the nut 168 and pin 167 along groove 153. When valve body 160 is in the desired position to mounting means 150, nut 168 is tightened fixing the relative positions. In the position shown in FIG. 10, ram air flows in through ram air opening 164 and out through hose connection 155.

A preferred embodiment of the add-on system mounting means and valve assembly is generally referred to in FIGS. 11 and 12 by numeral 170. The mounting means and valve body are similar to the mounting means and valve body shown in FIG. 10. In FIG. 11 the groove 172 formed in the mounting means body is more narrow than corresponding groove 153 shown in FIG. 10. A bent spring wire 174 is connected to the valve body and guides the valve body in and out of the mounting means by moving the wire along groove 172.

As shown in FIG. 12 the guide spring wire 174 has a throat portion 176 which extends through a slot in the outer cylindrical wall 152. The throat area 176 of spring wire 174 is tightly fixed in an opening in valve body 160. A portion of the spring wire 178 extends into the valve body and into an internally recessed groove 180 formed circumferentially around the inside of valve body 160. A portion of the spring wire 182 continues around the groove to a point near the entry of the spring wire into the valve body.

An outer portion of the spring wire 174 is bent into a handle 184. A terminal portion 186 of handle 184 cooperates with a detent 190 to stop the relative movement of the valve body and mounting means at desired positions. The detent 190 is formed from an elongated curved piece of material which may be similar to the material with which mounting means 150 is formed. Inner surface 192 of detent means 190 is welded or bonded to the outer surface of the cylindrical wall 152 of the mounting means 150. An outer edge 194 of detent means 190 is serrated or grooved to receive the distal end 186 of the spring handle 184. When the valve body is moved inward or outward with respect to the mounting means, the spring handle 184 is gripped between the fingers and end 186 is urged slightly away from serrations 194 against the spring pressure. The spring wire is then slid along groove 172 to position valve body in the mounting means as desired. Releasing the handle causes the spring pressure to press end 186 into locked position with serrations in surface 194.

The system of the present invention used with fixed ram air supply installations is shown in FIGS. 13 and 14. In the FIG. 13 embodiment the fixed installation is generally indicated by the numeral 200. Aircraft skin 202 has a conventional NASA air scoop 204 formed therein. A depressed central area in the air scoop leads to an opening 205 which leads to a plenum chamber 206 to which fixed pipes 208 and 209 are attached. At a distal end of pipe 208 a hose connection 210 is formed. A proximal end of flexible hose 212 is connected to hose connection 210, and a distal end 216 of hose 212 is connected to a mask or face tent 218 which is secured to a head of a user by straps 219.

In FIG. 14 similar elements have similar numbers. Fixed pipe 208 has several termni with "eyeball" type valves 222 conventionally used for directing air toward crew and passengers. The eyeball valve has a control 224. A special form of the valve modified for the present invention has an extension 226 which forms a hose connection. Flexible hose 228 has a proximal end connected to the extension 226.

In FIG. 14 the control 224 is used to turn off or on or control flow through flexible hose 228 and mask 218. In FIG. 13 a conventional valve 214 may be provided at the proximal or distal end of the flexible hose or at an intermediate point on the hose for controlling, stopping or permitting air flow.

While the invention has been described with reference to specific embodiments, modifications and variations of the invention may be made without departing from the scope of the invention.

The scope of the invention is defined in the following claims.

I claim:

1. Small aircraft low altitude emergency outside ram air breathing supply apparatus comprising:

ram air source means for scooping external ram air from outside of an aircraft, the ram air source means having an inlet adapted to be mounted outside of an aircraft and an outlet adapted to be mounted inside of an aircraft, said ram air source means including mounting means adapted to be mounted in a surface structure of the aircraft, opening and closing means connected to the ram air source means and extending inward in the aircraft for selectively opening and closing the ram air source means and thereby selectively scooping external ram air from outside of the aircraft, connection means connected to the outlet of the ram air source means inside the aircraft for connecting a conduction means to the ram air source means, ram air conduction means having first and second ends, the first end of the conduction means connected to the connection means for conducting ram air scooped from outside the aircraft by the ram air source means into the conduction means, the second end of the conduction means being freely movable within the aircraft in relation to the connection means and the ram air source means for positioning the second end of the conduction means near a face of a user, support means connected to the second end of the conduction means for supporting the second end of the conduction means near a face of a user, attachment means connected to the support means for attaching the support means to a user, distribution means connected to the support means and connected to the second end of the conduction means for distributing substantially unpressurized, free flowing ram air from the ram air source and the conduction means to a facial area of a user, thus providing emergency outside ram air from outside of an aircraft to a user inside of the aircraft whereby a small aircraft controlled by the user may be flown to a safe landing area and safely landed during an emergency in which smoke or noxious fumes fill an interior of the small aircraft.

2. The apparatus of claim 1 wherein the distribution means and support means comprises an upward opening mask having means for holding the mask on a chin of a user and means for directing air upward over the mouth, nose and eyes of the user.

3. Emergency outside air breathing supply apparatus comprising outward opening mounting means having an open outer end for mounting an outer surface of an aircraft body and extending into the interior thereof providing a passageway between said outer surface and said interior, valve means connected to the mounting means for opening and closing the passageway, means for extending outside of the aircraft body when the valve means is open for extending into an airstream and scooping air inward, distribution means connected to the valve means for conducting air scooped from the airstream, the distribution means including a flexible hose having a proximal end connected to either one of the mounting means and the valve means and having a distal end, and having a flow directing means at the distal end for directing flow from the distal end of the hose toward a face of a user, wherein the valve means comprises a valve body having a configuration similar to the mounting means and fitting within the mounting means and wherein the valve body has a closed outer end, a ram air opening in a wall of the valve body near the closed outer end, means for pushing the valve body partly outward through the opening in the outer end of the mounting means whereby the ram air opening in the wall of the valve body is exposed to the air flowing by the mounting means, whereby air is rammed into the opening, and connection means mounted in a side wall of the valve body in a position remote from the opening in the side wall and remote from its closed outer end for connecting the proximal end of the flexible hose to the valve body and further comprising a U-shaped opening in the mounting means extending from a second end of the mounting means toward a first end of the mounting means for receiving the connection means whereby the valve body may be moved in the mounting means to positions in which the ram air opening in the wall of the valve body is positioned fully within the mounting means out of air flow, and a position in which the ram air opening in the side wall is positioned outward of the outer opening in the mounting means, and intermediate positions in which the opening in the side wall valve body is partially exposed to air flowing outside the aircraft.

4. The apparatus of claim 3 wherein the U-shaped opening is irregular, whereby the connection means is gripped by the opening for holding varied positions of the valve body with respect to the mounting means.

5. The apparatus of claim 3 further comprising positioning means connected to the valve body and to the mounting means for moving the mounting means with respect to the valve body to control exposure of the opening in the side wall of the valve body to air flowing outside the aircraft.

6. Emergency outside air breathing supply apparatus comprising outward opening mounting means having an open outer end for mounting an outer surface of an aircraft body and extending into the interior thereof providing a passageway between said outer surface and said interior, valve means connected to the mounting means for opening and closing the passageway, means for extending outside of the aircraft body when the valve means is open for extending into an airstream and scooping air inward, distribution means connected to the valve means for conducting air scooped from the airstream, the distribution means including a flexible hose having a proximal end connected to either one of the mounting means and the valve means and having a distal end, and having a flow directing means at the distal end for directing flow from the distal end of the hose toward a face of the user, wherein the valve means comprises a valve body having a configuration similar to the mounting means and fitting within the mounting means and wherein the valve body has a closed outer end, a ram air opening in a wall of the valve body near the closed outer end, means for pushing the valve body partly outward through the opening in the outer end of the mounting means whereby the ram air opening in the wall of the valve body is exposed to air flowing by the mounting means, whereby air is rammed into the opening, and wherein a second end of the mounting means is closed and wherein a second end of the valve body is open and further comprising a connection means connected to the mounting means for connecting the proximal end of the flexible hose to the mounting means.

7. Emergency outside air breathing supply apparatus comprising outward opening mounting means for mounting on an outer surface of an aircraft body and extending into the interior thereof providing a passageway between said outer surface and said interior, valve means connected to the mounting means for opening and closing the means for scooping outside air inward when the valve is open, wherein an opening is provided in the outer end of the mounting means and the valve means comprises cover means for overlying the opening, and positioning means connected to the cover means and to the mounting means for closing or opening the cover means and for holding the cover means closed or open in preselected positions to scoop air flowing outside the aircraft into the mounting means, distribution means connected to the valve means for conducting air scooped from the air stream, the distribution means including a flexible hose having a proximal end connected to the mounting means and having a distal end and having a flow directing means at the distal end for directing flow from the distal end of the hose toward a face of a user, and wherein the mounting means has a closed second end and has a connection for mounting the proximal end of the flexible hose.

8. The apparatus of claim 7 wherein the positioning means comprises a lever pivoted to the cover means and extending outside of the mounting means.

9. The apparatus of claim 8 wherein a spring connected to the lever and cover means biases the lever into engagement with locking means on the mounting means.

10. Aircraft emergency breathing apparatus comprising air scoop means for scooping air from an air stream surrounding an aircraft, means for deploying the air scoop means in the air stream and means for withdrawing the air scoop means from the air stream, the air scoop means comprising a tubular body having a closed outer end and having an air scoop opening in a side of the tubular body facing an air stream, and a second tubular body having a closed inner end adapted to be mounted on the aircraft for slidably supporting the first tubular body, hose connection means being mounted on the second tubular body, a hose having a proximal end connected to the connection means, air directing means connected to a distal end of the hose, attaching means for attaching the air directing means to a head of a user to direct air onto a face of the user.

11. The apparatus of claim 10 wherein the means for deploying the air scoop means and means for withdrawing the air scoop means comprise adjustable connection means between the first and second tubular bodies.

12. The apparatus of claim 11 wherein the adjustable connection means comprises a pin connected to the tubular body extending through an opening in the second tubular body and means for selectively immobilizing the pin with respect to the second tubular body.

13. The apparatus of claim 11 wherein the adjustable connection means comprises spring means connected to the tubular body extending through an opening in the second tubular body and detent means connected to the second tubular body for selectively engaging the spring means.

* * * * *